United States Patent [19]

Thaxter

[11] 4,295,442

[45] Oct. 20, 1981

[54] MAGNETIC TONER APPARATUS

[75] Inventor: James B. Thaxter, Townsend, Mass.

[73] Assignee: Sperry Corporation, New York, N.Y.

[21] Appl. No.: 931,214

[22] Filed: Aug. 4, 1978

[51] Int. Cl.[3] ..... G03G 15/09

[52] U.S. Cl. ..... 118/657; 101/DIG. 13; 346/135.1; 118/623; 118/304; 118/308

[58] Field of Search ..... 118/657, 658, 623; 101/DIG. 13; 346/74.1, 103, 135.1; 209/230, 215

[56] References Cited

U.S. PATENT DOCUMENTS

| | | | |
|---|---|---|---|
| 2,930,351 | 3/1960 | Giaimo | 118/623 |
| 3,040,704 | 6/1962 | Bliss | 118/658 |
| 3,124,527 | 3/1964 | Watanabe et al. | 209/230 |
| 3,233,587 | 2/1966 | Morton | 118/657 |
| 3,550,153 | 12/1970 | Haeberle et al. | 101/1 |
| 3,929,098 | 12/1975 | Liebman | 101/DIG. 13 |
| 4,122,456 | 10/1978 | Berkowitz et al. | 118/657 |

*Primary Examiner*—Richard L. Schilling
*Assistant Examiner*—John L. Goodrow
*Attorney, Agent, or Firm*—Howard P. Terry

[57] ABSTRACT

Magnetic apparatus for dispensing toner of an electrophoretic printer having a hopper fed magnetic brush in conjunction with an active or passive magnetic backing plate is disclosed for transferring a uniform layer of toner to a transfer surface or belt for high speed printing purposes. The magnetic apparatus includes a magnetic roller having an inner magnetic surface and an outer cylindrical surface disposed in magnetic relationship to the toner and opposite one side of the transfer surface. The apparatus further includes a magnetic backing plate disposed opposite the other side of the transfer surface and juxtaposed to said magnetic roller for transferring the toner to the transfer surface.

8 Claims, 4 Drawing Figures

MAGNETIC TONER APPARATUS

BACKGROUND OF THE INVENTION

1. Field of the Invention

This invention relates to printing apparatus and, more particularly, to magnetic means for controlling the application of a toner to a transfer surface prior to printing.

2. Description of the Prior Art

Printing methods which employ an electrical field to move particulate printing material, toner, to a recipient sheet are known in the prior art. One such printing process employs a printing sheet and a transfer surface or belt from which the toner is conveyed to a print head which establishes an electrical field for transferring the toner material to the recipient sheet or paper. The imprinted paper passes over a hotplate of sufficient temperature and length to fuse the paper and toner. A method of supplying toner to the recipient sheet that has been considered envisions using a permanently toned ribbon which would be used only once and then discarded. As this scheme is generally not practical, a continuous printer having a retoneable transfer surface or belt in contact with the toner, preferably a toner bead, for coating the belt has been considered. The rotating toner bead is comprised of fine magnetic particles and is formed by the magnetic field gradients of a plurality of magnets employed above and below the bead and on opposite sides of the belt.

In general, the rotating magnetic bead scheme works well at low belt velocities, that is, on the order of 20 inches per second, and when used with a rough surface belt. Present printing requirements, however, indicate that printing speeds on the order of 50–60 inches a second or more are desirous. However, as the rotating magnetic bead tends to fly apart at belt velocities on the order of 30 inches per second, a 60 inch per second belt velocity would require a bead four times larger in diameter and magnets eight times more massive (assuming the same magnetic material) than those originally used in the 20 inch per second system. Furthermore, at these faster speeds, uniform coating of the transfer surface is difficult.

Accordingly, there is a need for providing means for operating a non-impact printer at increased velocity which uniformly coats the transfer surface with sufficient toner for good printing characteristics.

SUMMARY OF THE INVENTION

According to the invention, means for magnetically transferring toner to the transfer surface of a non-impact printer is provided. Illustratively, the apparatus of this invention includes a magnetic roller disposed in magnetic relationship to a supply of toner for magnetically attracting and/or holding the toner disposed thereon to the surface of the roller and a backing plate disposed opposite the transfer surface and juxtaposed to the magnetic roller for transferring the toner from the magnetic roller to the transfer surface.

Specifically, the apparatus of this invention includes a magnetic roller disposed in magnetic relationship to the toner and opposite one side of the transfer surface having an inner magnetic surface and an outer cylindrical shell; the inner magnetic surface magnetically attracting the toner to the outer shell from a toner supply hopper. Furthermore, the apparatus of this invention includes an active or passive magnetic backing plate to assist toner transfer from the magnetic roller to the transfer surface or belt.

More specifically, the backing plate may be selectively profiled to control the strength of the magnetic field for transferring the toner from the magnetic brush to the transfer surface, and may be comprised of permanent magnetic material or current carrying conductors and other material suitably chosen to establish the desired magnetic field gradients to aid toner transfer to the transfer surface.

DESCRIPTION OF THE PREFERRED EMBODIMENT

For a more complete appreciation of the invention, attention is invited to the following description of an illustrative embodiment of the invention, as shown in the attached drawings.

Figure 1:
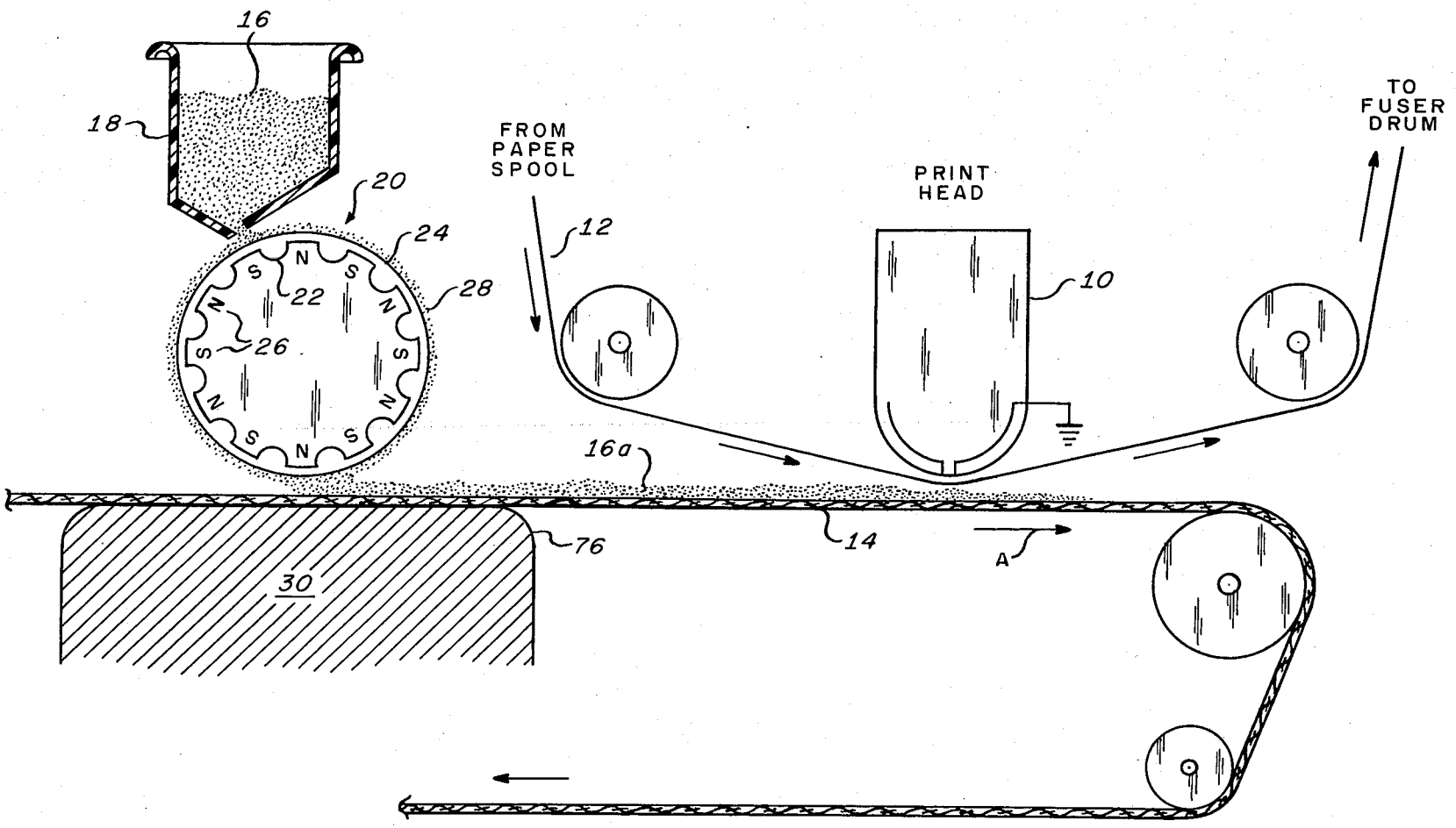
FIG. 1 is a schematic of a printing process embodying principles of this invention.

Illustrated in FIG. 1 is an electrophoretic printing process, known in the art, such as disclosed in Haeberle et al U.S. Pat. No. 3,550,153, granted on Dec. 12, 1970, embodying a print head 10, a supply of recipient sheet or paper 12, from a paper supply or spool not shown, conveyed by suitable means across the print head 10 to a fuser section not shown. The printing process further includes a transport surface or belt 14 for conveying a supply of toner 16 from a toner hopper 18 in a uniform layer 16*a* to the print head 10. The toner particles 16 are typically of the form of a solid shell of a magnetic oxide $Fe_3O_4$ powder in a pigmented resinous binder coated with a carbon powder to provide a conducting surface thereon. In the electrophoretic printing process, the toner particles are transferred from the belt 14 to the paper 12 by means of the electrical field initiated by the print head 10. The magnetic oxide or iron oxide $Fe_3O_4$ content of the toner particle 16 is advantageously used in this invention such that high speed printing may be accomplished in the presence of less intense magnetic field thereby resulting in significantly smaller or less massive magnets required to produce the necessary controlling forces.

Specifically, in order to provide a uniform layer of toner particle 16*a* on the belt 14, a magnetic brush 20 is disposed beneath the hopper 18 to attract toner particles 16 released from the hopper 18 to the brush 20 for uniform deposit on the belt 14. The magnetic brush 20 comprises an inner surface 22 and an outer shell 24. The inner surface 22 is formed of a magnetic material having a repetitive pole configuration, that is, a repeating North (N), South (S) fingerlike pole extension configuration 26, which attracts the magnetic toner particles 16 to the outer shell 24 of the brush. The magnetic roller 20 therefore attracts a layer of toner particles 28 disposed about the periphery of the roller for transferal to the belt 14. It is noted that the roller may be made of sufficiently large radius to reduce the centrifugal force on the toner 16 or layer 28 for a given tangential velocity of the roller and surface velocity of the belt. In addition, the centrally located magnetic pole configuration 26 or the resultant magnetic field gradients thereof exert a relatively constant centripetal force on the toner layer 28 to confine it to the roller 20.

In order to transfer the toner 16 from the magnetic roller toner layer 28 to the belt 14 forming toner layer 16*a*, a mechanism is required which releases the toner from the magnetic brush. That is, a mechanism which releases the magnetic field gradient's attraction holding the toner particles to the roller is necessary for forming a uniform toner layer 16*a* on the belt 14. Accordingly, a planar backing plate 30 is disposed opposite the roller 20 such that the belt 14 lies between the roller and the backing plate and rides upon the backing plate 30. Preferably, the backing plate 30 is disposed below the belt 14 with the roller 20 disposed directly above the belt such that advantageous use of gravitational forces may also be accounted for. The planar backing plate is formed of a high permeability ($\mu$) material and disposed relatively close to the roller 20 to satisfy magnetic boundary conditions on the surface of the plate 30. It is noted that the magnetic field of the roller 20 will induce a magnetization in the highly permeable backing plate 30 which sets up opposing forces to reduce the net normal force on the toner particles in the vicinity between the roller and the backing plate. Accordingly, the high permeability of the backing plate 30 or the induced magnetization thereof results in the cancellation of the tangential component of the magnetic field and the normal magnetic field gradient attracting the toner to the magnetic roller 20 and thereby cancels the centripetal force on the toner layer 28 near the surface of the backing plate such that the toner particles 16 may be deposited on the belt 14 in a uniform manner forming toner layer 16*a*. Thus, high speed printing may be accomplished due to the deposition or transferal of a uniform toner layer 16*a* on the belt 14 by means of the magnetic roller 20 in cooperation with the backing plate 30 of high permeability material.

The apparatus of this invention performs its function by means of the magnetic field gradients of the magnetic roller 20, the induced field gradients set up within the backing plate 30 in the vicinity of the roller 20 and by interaction of the magnetic field on the magnetic material of the toner particles 16. For example, the particles 16 have only a moderate or average susceptibility and therefore may be considered "soft" magnetic materials. They demagnetize readily such that the magnetization (M) of the particle may be expressed by the relation:

$$M = xH$$

where x is the particle susceptibility, and

H is the magnetic field strength. Also, it can be shown that the force (F) acting on a toner particle of the above type is proportional to the product of the susceptibility (x) times the gradient of the square of the applied magnetic field:

$$F\alpha \times \nabla H^2$$

Thus, if the gradients in the magnetic field approach zero at the surface of the high permeability magnetic plate 30, i.e., if the magnetic field component normal to the backing plate 30 approaches a constant value and the tangential component of the field and the spacial derivatives thereof approach zero, the force (F) acting on a particle which is proportional to the gradient of the square of the magentic field also approaches zero. Therefore, the magnetic field gradients modified by the magnetization induced within the backing plate affect the magnetic field holding the toner particles 16 to the roller 20 such that the force field of the brush 20 is effectively reduced at the surface of the backing plate 30 upon which the belt 14 is traversing. In this manner, contact between the rough surface of the belt 14 and the toner particles 16 of the layer 28 encircling the brush results in a uniform capture or transfer of toner particles to the belt.

In addition to the action of the planar backing plate described above in connection with FIG. 1, FIGS. 2, 3 and 4, indicate further embodiments of this invention. Specifically, although the planar backing plate 30 of FIG. 1 described above is advantageously used to reduce the magnetic field gradients and hence reduce the attraction force on the magnetic particles 16, which tends to make the particles cling to the roller 20, and thus passively transfers particles to the belt, the action of specially shaped backing plates may be utilized to actively attract the particles to the backing plate. That is, active attraction or transferal to the belt 14 may be accomplished by setting up special magnetic field gradients in the backing plate that are oppositely directed and greater in magnitude than the gradients produced by the magnetic roller 20 at the belt surface. Attention is invited to FIG. 2 wherein a further embodiment of the instant invention, a shaped high permeability plate 40, is depicted. The shaped plate 40 is shown disposed beneath the magnetic roller having a flat or planar top surface 41 and a planar side face portion or edge 42 intersecting the top surface 41 and forming a sharp corner 44 running substantially parallel to the axis of the roller 20. The magnetization induced in the high permeability backing plate 40 by the magnetic roller 20 produces high magnetic field gradients near the sharp corner 44 which actively forces the toner particles 16 toward the edge 44 and onto the belt surface 14 disposed between the roller and the plate. Assuming the motion of the belt 14 to be in the direction of arrow A of FIGS. 1 and 2, that is, in the direction toward the edge 42 of the backing plate 40, the toner particles 16 that are forced onto the belt 14 move to a gradient-free region which is created by the high permeability backing plate as indicated above.

Figure 3:
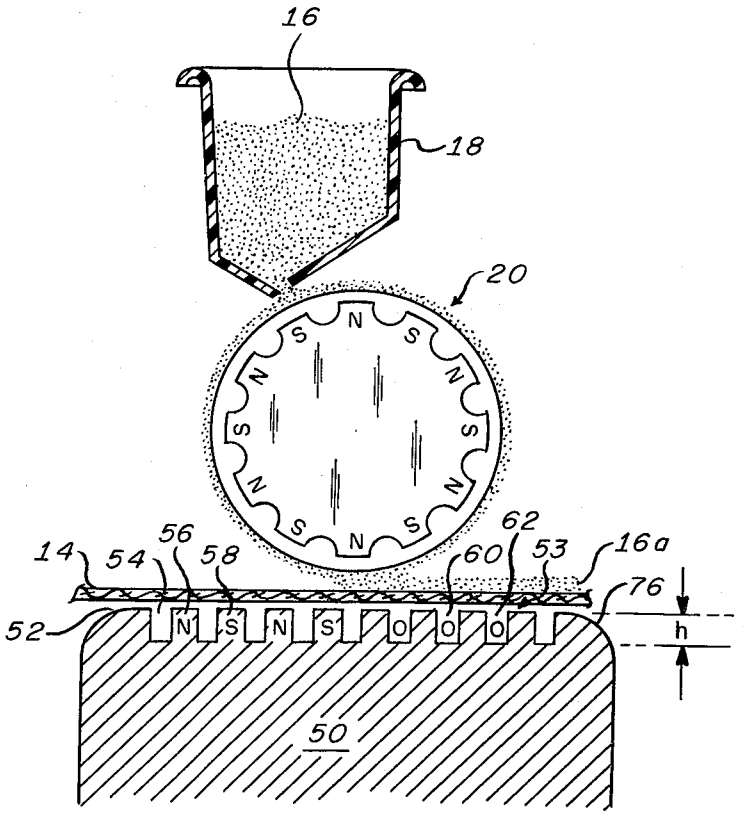
FIGS. 2, 3 and 4 indicate further embodiments of the invention described herein.

Referring to FIG. 3, a further embodiment of the instant invention is directed to the magnetic backing plate 50. The magnetic plate 50 of this embodiment includes special shaping of the plate top surface 52 such as the periodic steps or changes in height 53 indicated in FIG. 3 to produce selectively profiled force gradients. The periodic steps or the special shaping 53 of the plate 50 controls the range and strength of the particle magnetic force near the plate surface. In the figure, the special shaping 53 of the plate 50 is depicted as a square step of constant period and constant height formed on the surface of the backing plate 50. The voids 54 of the periodic steps 53 may be filled with any material having a different permeability from that of the backing plate such that a smooth surface is provided upon which the belt 14 may traverse and which prevents magnetic particle 16 from lodging therein. In general, if the backing plate 50 or steps 53 have a permeability ($\mu$) and the voids 54 are formed of periodic steps of material having a permeability ($\mu_1$) the magnitude of the surface directed normal force component due to the magnetic field gradient will generally increase with step height (h), permeability ratio ($\mu/\mu_1$) and magnetic field strength (H). In addition, the backing plate as shown in FIG. 3 may be comprised in part or totally of permanent magnetic material which may be disposed in alternating pole (North-South) configuration 56, 58 to provide the desired periodic or active magnetization of portions of the plate 50. Specific combinations of the periodic distribution of the magnetic material (N-S) may be prescribed to control the range and magnitude of the force fields near the surface 52 of the plate 50 where the transport belt 14 is located. In addition, the backing plate may be comprised of current carrying conductors 60 to establish the desired magnetic field gradients to assist toner transfer to the belt. For example, current carrying conductors 60 are shown in FIG. 3 as copper conductors arranged within the voids 54 to alternately magnetize in a step-like fashion the magnetic material of the backing plate 50. Therefore, the backing plate 50 may be specifically designed to control the distribution of toner on the belt and transport it from the magnetic roller 20 to the printing head 10.

Figure 2:
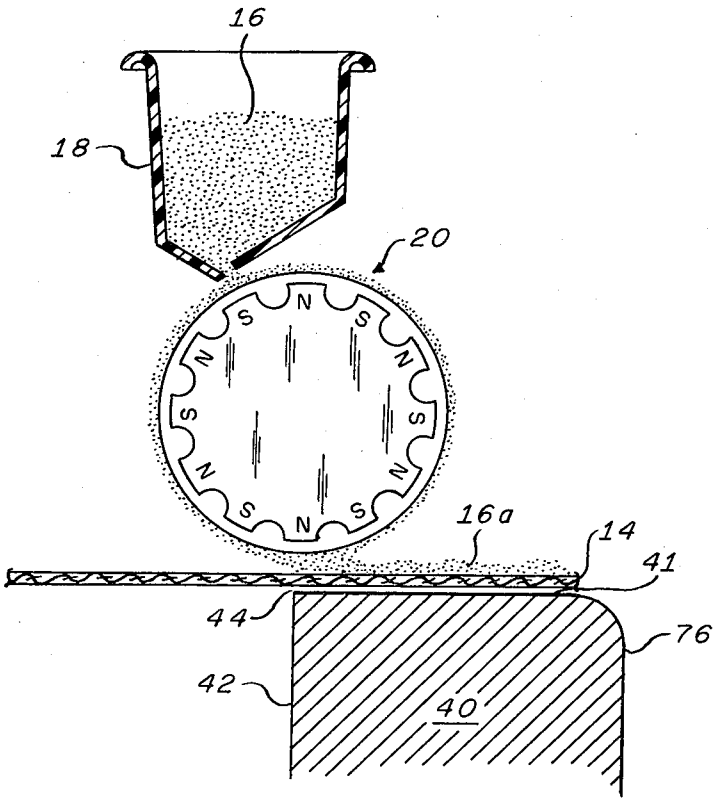
Figure 4:
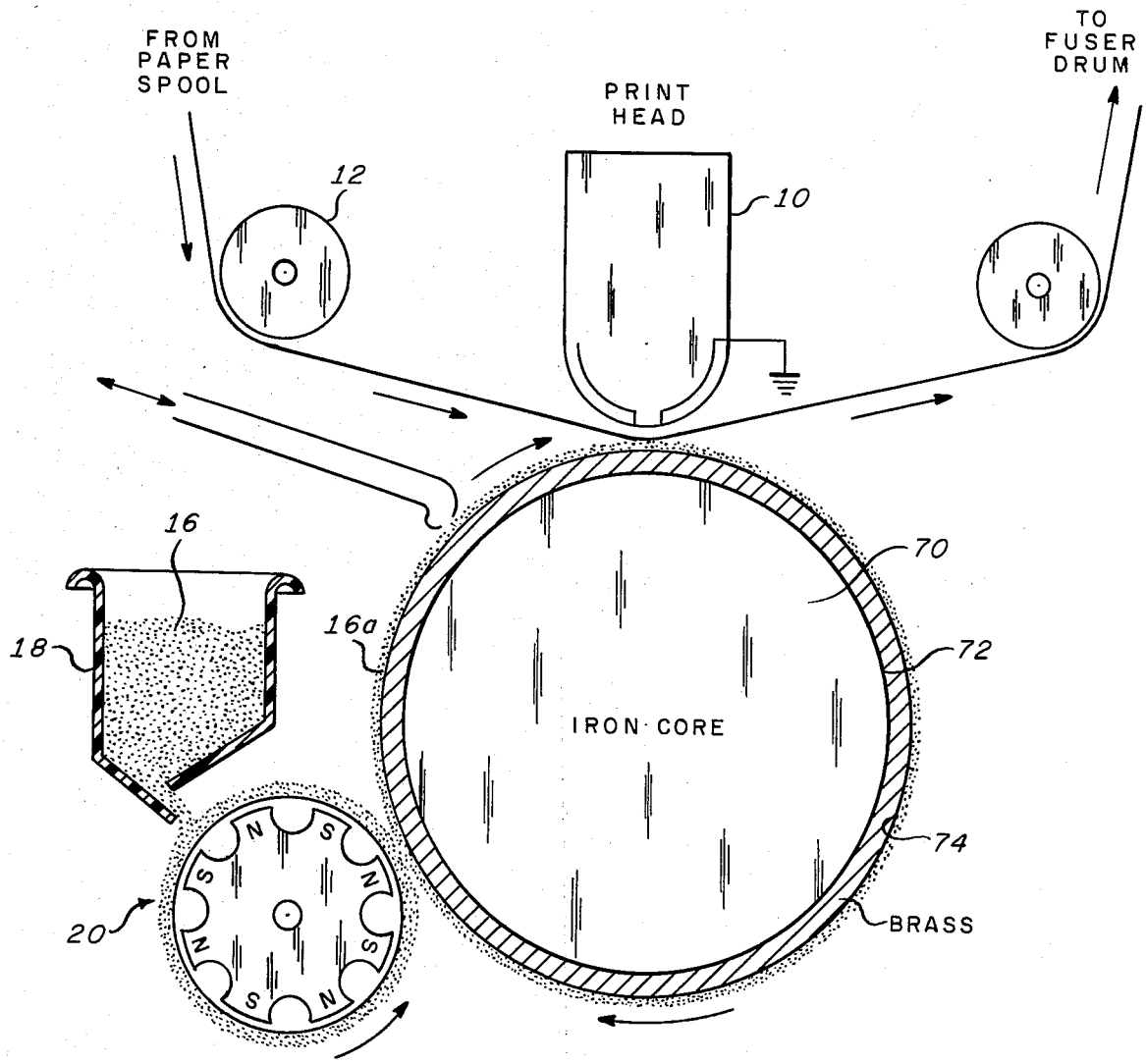

A further embodiment of the apparatus of this invention is shown in connection with FIG. 4 wherein the magnetic roller 20 is associated with a substantially larger roller 70 comprised of a high permeability magnetic material inner surface 72 and an outer transfer surface 74 upon which the uniform layer 16*a* of toner particles 16 is deposited. The backing plates of FIGS. 1, 2 and 3 are shown as having a gradual separation from the planar surface beneath the belt 14, that is, as having a rounding contour 76 situated sufficiently away from the magnetic roller 20 in the direction A of the movement of the belt 14. The position of this rounding contour 76 is determined by the magnetic field gradients of the roller and therefore is disposed sufficiently away from the roller to assure that the particles 16 are substantially out of the influence of the magnetic field gradients of the roller 20. This position is usually several times the distance (P), FIG. 4, separating the adjacent poles on the magnetic roller 20. Accordingly, in FIG. 4 the backing plate 72, formed as a cylindrical drum, is of sufficiently large radius as compared to the radius of the magnetic roller 20 such that the local curvature of the transfer surface 74 of the drum is sufficiently large as compared to the distance (P) between adjacent pole pieces on the roller 20. Thus, the transfer region between the roller 20 and backing plate 72 may be assumed to be effectively flat as in FIGS. 1, 2 and 3 and the effective curvature occurs sufficiently away from the influence of the magnetic roller field gradients such that effective transfer of a uniform layer of toner to the backing plate transfer surface 74 is obtained.

In accordance with the apparatus of this invention a magnetic transfer system is provided which prevents high speed printing by uniformly distributing a supply of toner particles to a transport surface for transport thereof to a print head.

While the invention has been described in its preferred embodiments, it is to be understood that the words which have been used are words of description rather than limitation and that changes within the purview of the appended claims may be made without departing from the true scope and spirit of the invention in its broader aspects.

I claim:

1. An improved electrophoretic printer of the type having a recipient sheet, a printhead, a supply of toner, and a transfer surface having first and second sides, for conveying the toner to the printhead for transferring the toner to the recipient sheet to form an image thereon, wherein the improvement comprises:

a magnetic roller disposed in magnetic relationship to the supply of toner and opposite the first side of the transfer surface, having an inner magnetic surface and outer cylindrical shell, for generating magnetic field gradients and magnetically attracting the toner to the outer cylindrical shell; and a high permeability backing plate disposed opposite the second side of the transfer surface and aligned with the magnetic roller cooperating therewith for modifying the magnetic field gradients by magnetization induced in the high permeability backing plate having a selectively profiled surface to produce selectively profiled gradients and for transferring the toner from the roller to the transfer surface in a controlled, uniform thickness.

2. An electrophoretic printer according to claim 1 wherein the high permeability backing plate includes a planar surface disposed opposite the transfer surface.

3. An electrophoretic printer according to claim 1 wherein the high permeability backing plate includes a first planar surface disposed opposite the transfer surface and a second planar surface intersecting the first surface forming a sharp corner aligned with the axis of the roller.

4. An electrophoretic printer according to claim 1 wherein the selectively profiled surface of the backing plate includes a square step of constant height and constant period forming voids between the steps.

5. An electrophoretic printer according to claim 1 wherein the selectively profiled surface includes first step portions of one permeability and second step portions of a second permeability.

6. An electrophoretic printer according to claim 4 wherein the square steps include permanent magnetic material.

7. An electrophoretic printer according to claim 4 further including current carrying conductors.

8. An electrophoretic printer according to claim 1 wherein the high permeability backing plate includes a roller having a magnetic inner surface and the transfer surface is superimposed around the roller.

* * * * *